US008100420B2

(12) United States Patent
Sentagnes

(10) Patent No.: US 8,100,420 B2
(45) Date of Patent: Jan. 24, 2012

(54) SKATEBOARD

(76) Inventor: Bruno Sentagnes, Bordeaux (FR)

( * ) Notice: Subject to any disclaimer, the term of this patent is extended or adjusted under 35 U.S.C. 154(b) by 449 days.

(21) Appl. No.: 12/301,468

(22) PCT Filed: May 16, 2007

(86) PCT No.: PCT/FR2007/051294

§ 371 (c)(1),
(2), (4) Date: Apr. 10, 2009

(87) PCT Pub. No.: WO2007/135328

PCT Pub. Date: Nov. 29, 2007

(65) Prior Publication Data

US 2010/0001483 A1 Jan. 7, 2010

(30) Foreign Application Priority Data

May 19, 2006 (FR) ..... 06 51836

(51) Int. Cl.
*B62M 1/00* (2010.01)

(52) U.S. Cl. ..... 280/87.042; 280/87.01; 280/87.03; 280/87.041

(58) Field of Classification Search ..... 280/87.01, 280/87.021, 87.03, 87.041, 87.042
See application file for complete search history.

(56) References Cited

U.S. PATENT DOCUMENTS

| | | | | |
|---|---|---|---|---|
| 4,061,350 | A | 12/1977 | Schmidt, Jr. et al. | |
| 4,180,278 | A | 12/1979 | Gottlieb | |
| 4,181,316 | A * | 1/1980 | Brand et al. | 280/11.207 |
| 4,194,752 | A * | 3/1980 | Tilch et al. | 280/11.28 |
| 4,221,394 | A * | 9/1980 | Campbell | 280/14.25 |
| 5,716,562 | A * | 2/1998 | Peart et al. | 264/45.3 |
| 6,214,142 | B1 * | 4/2001 | Saputo | 156/92 |
| 6,386,561 | B1 * | 5/2002 | Hanson | 280/87.042 |
| 6,474,666 | B1 * | 11/2002 | Andersen et al. | 280/87.041 |
| 6,527,284 | B2 * | 3/2003 | Bert | 280/87.041 |
| 6,547,262 | B1 * | 4/2003 | Yamada et al. | 280/11.28 |
| 6,648,363 | B2 * | 11/2003 | Gordon | 280/610 |
| 7,093,842 | B2 * | 8/2006 | Chmelar | 280/87.042 |
| 7,118,117 | B2 * | 10/2006 | Terry | 280/87.042 |
| 7,246,568 | B1 * | 7/2007 | Cheung | 114/357 |
| 7,347,431 | B2 * | 3/2008 | Hill et al. | 280/87.042 |
| 7,413,200 | B2 * | 8/2008 | Horn | 280/87.042 |
| 7,735,844 | B2 * | 6/2010 | Gallo | 280/87.042 |
| 2001/0019198 | A1 * | 9/2001 | Wolf | 280/609 |
| 2002/0030338 | A1 * | 3/2002 | Bert | 280/87.041 |
| 2006/0049596 | A1 | 3/2006 | Hill et al. | |
| 2006/0103098 | A1 * | 5/2006 | Esposito et al. | 280/87.042 |

FOREIGN PATENT DOCUMENTS

| | | |
|---|---|---|
| DE | 299 02 966 | 4/1999 |
| GB | 2 346 561 | 8/2000 |

OTHER PUBLICATIONS

International Search Report dated Nov. 19, 2007, from corresponding PCT application.

* cited by examiner

*Primary Examiner* — J. Allen Shriver, II
*Assistant Examiner* — Travis Coolman
(74) *Attorney, Agent, or Firm* — Young & Thompson

(57) ABSTRACT

A skateboard that includes a board (12) with an upper part (30) and a lower part (34), wheel supports (14), as well as elements (28) for orientation of the wheel supports (14), whereby the elements (28) for orientation include a pin (52) whose tip (54) is housed in a recess so as to create a connection that is essentially equivalent to a ball joint; the skateboard is characterized in that in its lower part (34), it includes receiving elements (58) that are manufactured with the board (12) and are able to accommodate each wheel support (14).

10 Claims, 4 Drawing Sheets

SKATEBOARD

Figure 1:
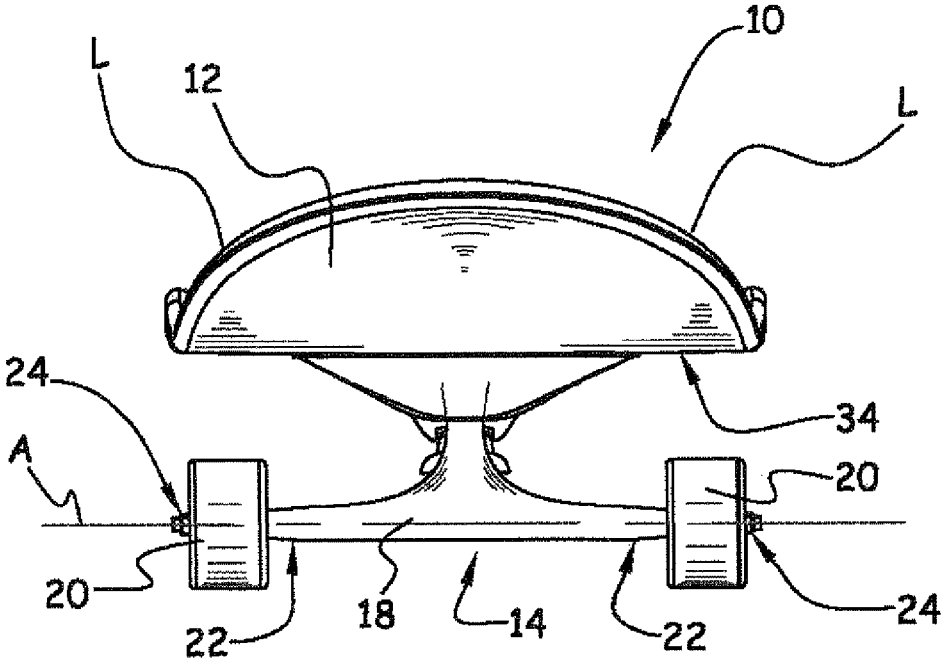

This invention relates to a skateboard.

Current skateboards generally consist of a board on which two "trucks" are mounted, whereby the trucks are the two elements that support the wheels and make it possible to provide the desired orientation to the skateboard by tilting said hoard under the action of the user.

The board is commonly manufactured either of plywood on its two faces or by assembly of several fine wood layers, glued then pressed on one another so as to ensure a solid bond between the various fine wood layers.

The board then accommodates a non-skidding adhesive on the upper part that allows its user to have the necessary adhesion for maneuvering and executing various types of jumps or figures with his skateboard.

During a "freestyle" use, various jumps or figures are made possible by, on the one hand, the presence of this non-skidding adhesive and, on the other hand, the presence of parts of the board that are bent upward and located at each end of said board.

The user often pushes on said bent parts, in particular during a so-called "freestyle" use of said skateboard, and produces numerous internal stresses on the plywood assembly of the board, and more particularly at right angles with the connection between the trucks and the board.

These internal repetitive stresses generally have the effect of breaking said skateboard during an impact, an involuntary cantilevering during a fall, or a voluntary cantilevering in the case of certain figures, called "slides" and executed by sliding the skateboard over an obstacle that has a smooth and projecting edge over a certain length. In addition, during certain figures called "blunt-slides," the connection, in particular by screw, between the truck and the skateboard is particularly stressed and deteriorates quickly until the connecting elements break.

The attachment of a truck is commonly carried out by means of four screws per truck, whereby said screws pass through the thickness of the board to make said truck integral with the board.

Initially, the piercing of the board all the way through and at 2×4 points that are relatively close to one another reduces the mechanical resistance of said board and offers preferred breaking zones.

Secondly, the openings through which the attachment screws pass are so many passages through which the water can infiltrate, whereby the service life of the plywood is shortened upon contact with water.

Thirdly, the stationary part of the truck that is attached to the board is approximately rectangular, causing the breaking of the board along the edges of said stationary part of the truck.

Another problem relative to an intensive use of a skateboard relates to the relative fragility of certain trucks and certain boards whose mechanical characteristics have been disregarded in favor of the lightness called for by the users. This is in particular the case when said users are judged in competitions during which the amplitude of the jumps that they carry out affects their ranking at the end of the competition.

In contrast, the current geometry of trucks does not facilitate the execution of figures such as the "slide," whereby the stationary part of the truck is designed primarily relative to criteria of solidity and to the standardization of said connection between the truck and the board.

Also, the invention has as its object to eliminate the drawbacks of the prior art by proposing a skateboard with a new design that makes it possible to limit the appearance of preferred breaking zones, in particular at the attachment of trucks, allowing an increase in weight and able to facilitate the execution of certain figures that are specific to this sport.

For this purpose, the invention proposes a skateboard that comprises a board with an upper part and a lower part, wheel supports, as well as means for orientation of said wheel supports, whereby said means for orientation consist of a pin whose tip is housed in a recess so as to create a connection that is essentially equivalent to a ball joint; said skateboard is characterized in that in its lower part, it comprises receiving means that are manufactured with said board and are able to accommodate each wheel support.

Figure 2:
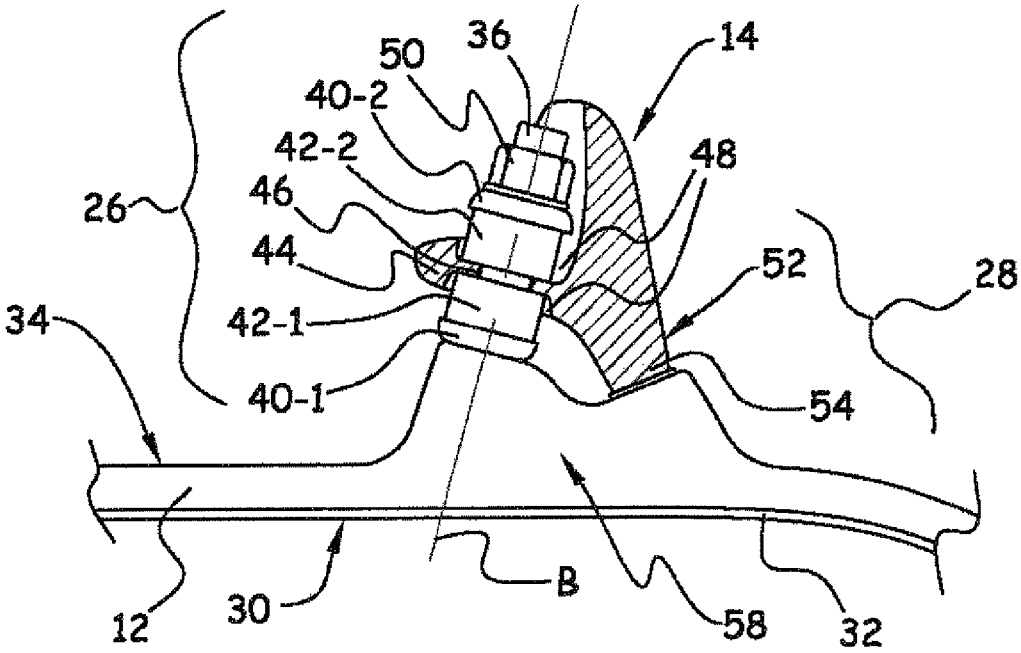
Figure 3:
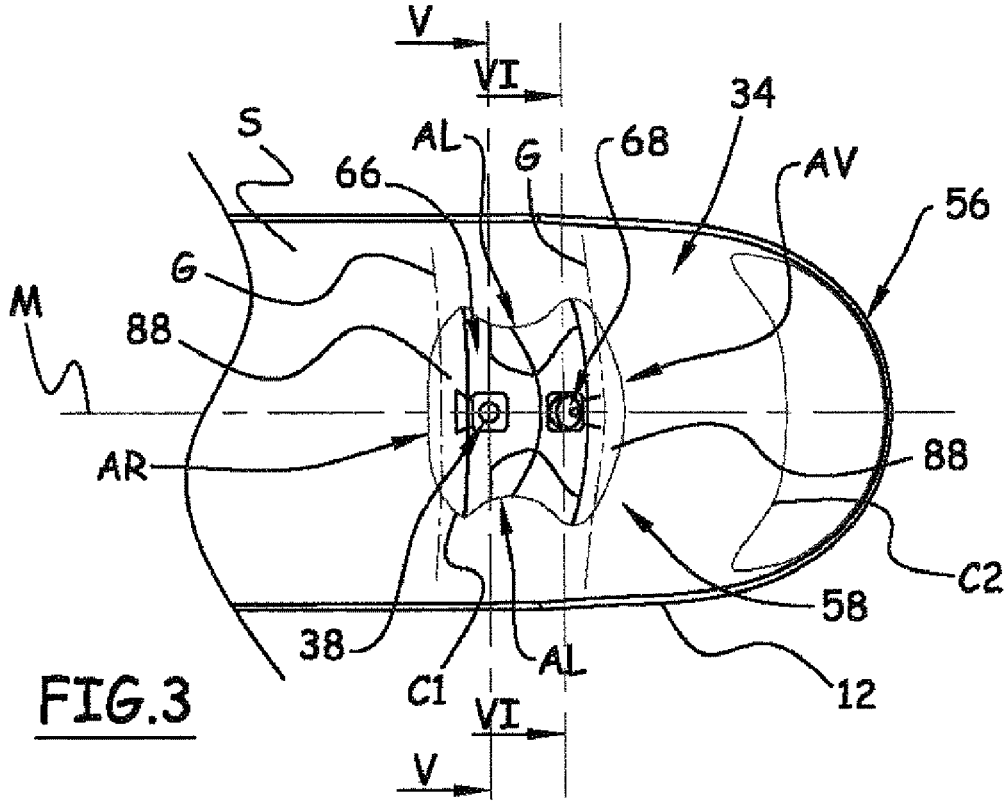
Figure 5:
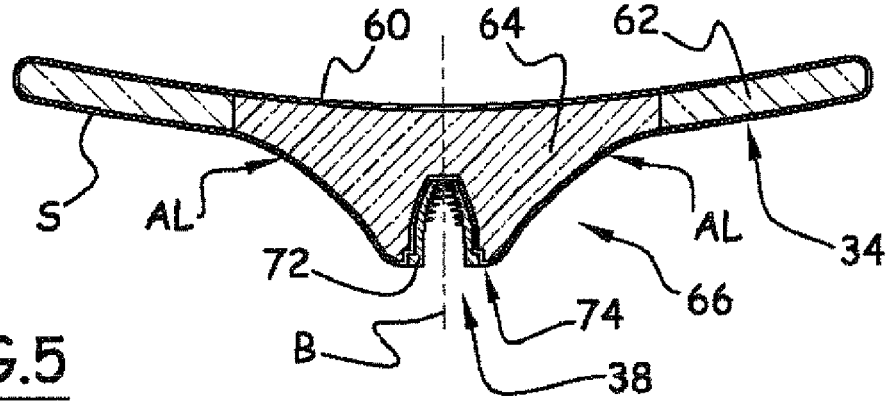
Figure 6:
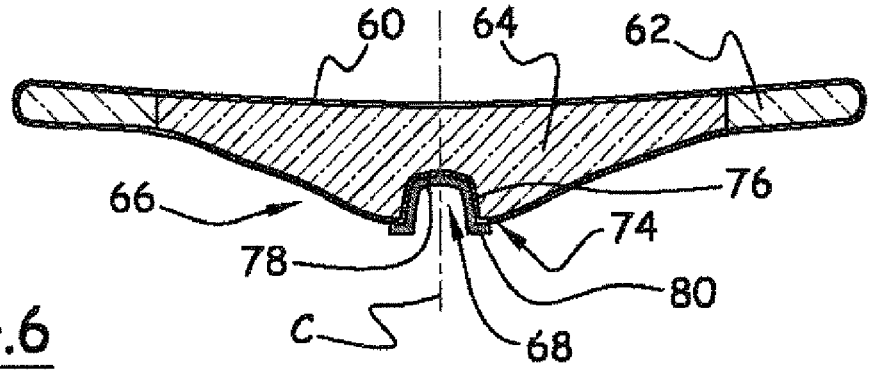
Figure 4:
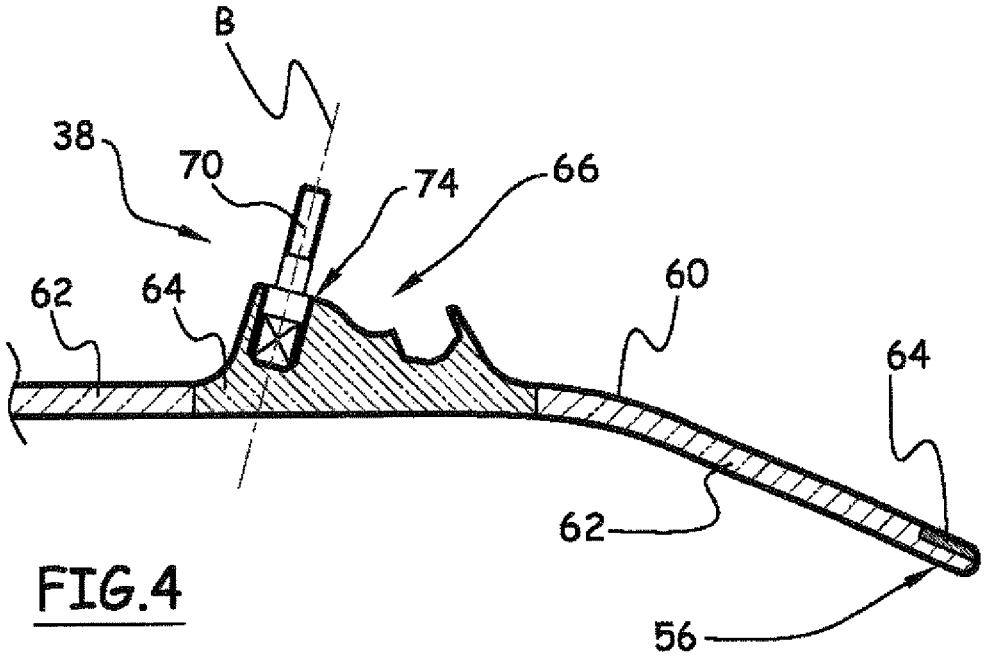
Figure 7:
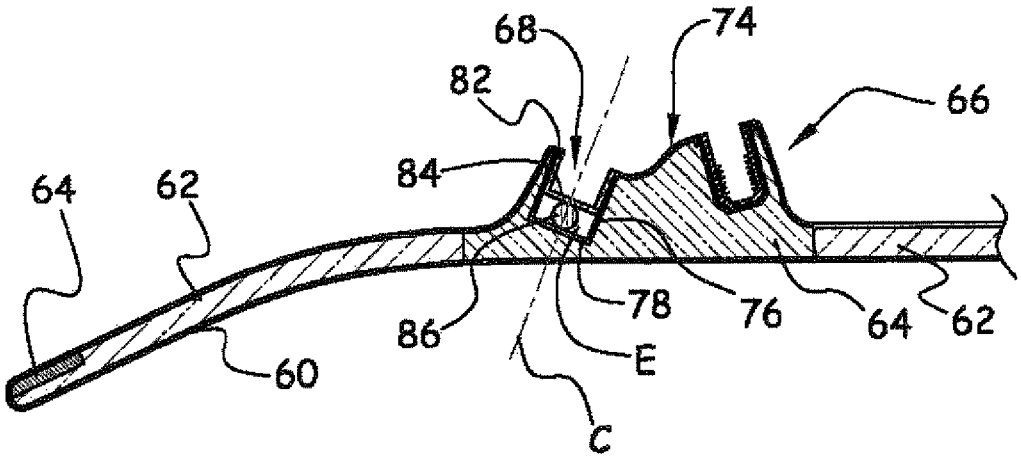
Figure 8:
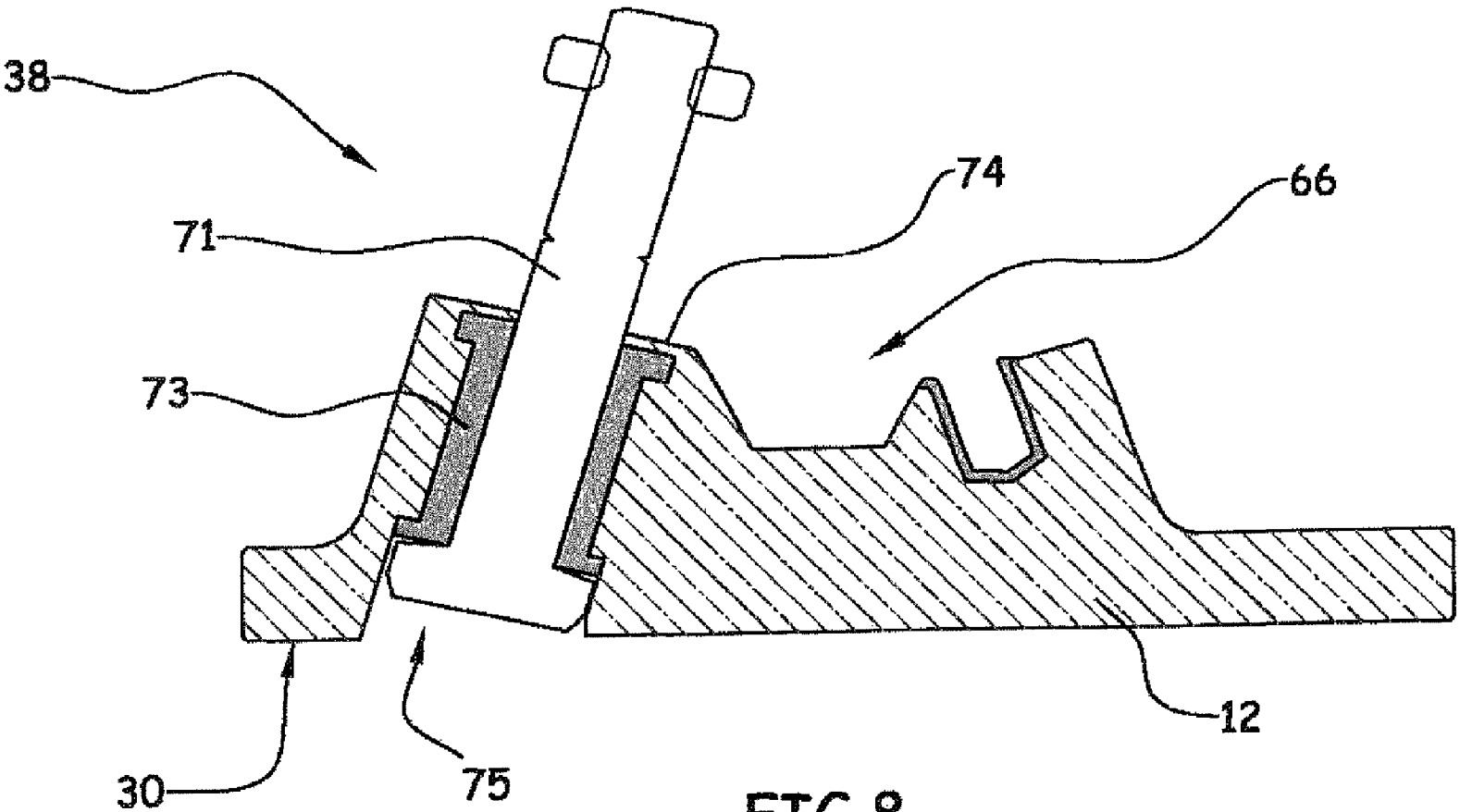

This invention is now described according to a particular embodiment, non-limiting, opposite accompanying drawings in which the various figures show:

FIG. 1, a frontal view of a skateboard according to the invention,

FIG. 2, a partial cutaway view of a side elevation of the skateboard according to the invention;

FIG. 3, a bottom view of a board according to the invention;

FIG. 4, a longitudinal cutaway view at receiving means according to a first embodiment of the engagement means;

FIG. 5, a transversal cutaway view at attachment means according to a second embodiment of the engagement means;

FIG. 6, a transversal cutaway view at orientation means according to a first embodiment of the recess;

FIG. 7, a longitudinal cutaway view along the longitudinal axis of the board at receiving means according to a second embodiment of the recess;

FIG. 8, a longitudinal cutaway view along the longitudinal axis of the board at receiving means according to a third embodiment of the engagement means.

In front view, FIG. 1 shows a skateboard 10 according to the invention; said skateboard 10 comprises a board 12, and at least two wheel supports 14, also called "hangers," mounted at the lower part of said board 12.

A wheel support 14 comprises an axle 18 that is approximately cylindrical in shape and elongated along an axis referenced A in FIG. 1 and with a length that is approximately equal to the width of the board 12. At least one wheel 20 is mounted at each end 22 of the axle, whereby said mounting is carried out, for example, by means of one pair of roller bearings per wheel 20 and tightening means 24 such as a nut that is screwed onto a threading provided on said end 22 of the axle. This mounting is not presented in more specific detail because it is part of the prior art and is not the object of this invention.

FIG. 2 shows the means 26 for attaching wheel supports 14 as well as orientation means 28 that make it possible for the user of the skateboard 10 to steer by making said wheel supports 14 pivot by exerting force on one of the two side parts L of the upper part 30 of the board 12.

Usually, said part 30 is coated by an adhesive 32 that has a non-skidding outside face, but the board 12 can also comprise a non-skidding upper part 30 that is manufactured with said board 12. The means 26 for attaching a wheel support 14 on the lower part 34 of the board 12 comprise a shaft 36, in particular threaded and located along a shaft line B, onto which are successively fitted the elements that compose said attachment as well as the wheel support 14.

The shaft 36 is integral with the board 12 by means of the engagement means 38 that are expanded upon later in the description because of being able to be the subject of various embodiments.

As illustrated in FIG. 2, the means 26 for attaching a wheel support 14 are an assembly that is obtained by successive arrangement on the shaft 36, also called "kingpin," of the following elements:

A first washer 40-1, in particular made of metal and flanged for assuming the shape of a first element 42;

A first element 42-1 that is approximately cylindrical and that comprises a passage for the shaft 36, whereby said first element 42-1, in particular made of elastomer, can be compressed during a force exerted by the user on one of the two side parts L of the upper part 30 of the board 12;

The wheel support 14 itself using a ring 44 that is located in a plane that is approximately perpendicular to said shaft B and a bore 46 through which the shaft 36 passes; said ring 44 comprises two housings 48, located on both sides of the bore 46 and with a diameter that is larger than said bore 46 so as to accommodate and hold the elements 42;

A second element 42-2, approximately identical to the first element 42-1;

A second washer 40-2, approximately identical to the first washer 40-1, and;

A nut 50, preferably a lock nut, which will hold and lock the assembly that is thus created.

The user can thus change as he wishes the elements 42, also called "gums," or the tightening torque of said attachment means 26 to influence the behavior and the reactivity of the skateboard 10.

The means 28 for orientation of the wheel support 14 consist of a pin 52 whose tip 54 is housed in a recess 56 that is made in the lower part 34 of the board 12, making it possible to create a connection that is essentially equivalent to a ball joint.

These orientation means 28 produce a rotation of the wheel support 14 in a way that is completely identical to the devices of the prior art, such as a truck.

Thus, during the use of the skateboard 10 and more particularly during a change in direction, the user exerts a force on one of the two side parts L of the upper part 30 of the board 12. The distance between the tip 54 of the pin 52 and the shaft A of the axle 18 being set, the axle 18 pivots around the pin 52 when said force is exerted in proportion to the ability to compress elastomer elements 42. However, this rotation is limited by the compression of elements 42, or "gums," which work in opposition given the assembly of the attachment means 26 of the wheel support 14. The tighter the assembly forming the attachment means 26 is made using the nut 50, the more prestressed the elements 42 will be and the greater the forces to be exerted by the user at the side parts L of the upper part 30 of the board 12 will be. This accounts for the influence on the behavior and the reactivity of the skateboard 10 cited above.

The skateboard 10 according to the invention comprises a board 12 and at least two wheel supports 14.

Said wheel supports 14 are identical and are mounted in opposition relative to one another, whereby the means 28 for orientation of each wheel support 14 are directed toward the end 56 of the closest board 12, as illustrated in FIG. 3.

Receiving means 58 are integrated in the lower part 34 of the board 12 to accommodate the orientation means 28 and the attachment means 26 of each wheel support 14. These receiving means 58 are part of the body of the board 12.

More specifically, these receiving means 58 are manufactured with said board 12, i.e., the production process that is used for the manufacturing of the board 12 makes it possible to generate the shape of the board 12 and the receiving means 58 simultaneously from the same material.

In a preferred embodiment, the board 12 is produced from at least one composite material. The use of a composite material, in particular based on fibers of carbon, glass or the like, is able to impart adequate mechanical characteristics to the board 12 while facilitating the production of complex shapes of the board 12 and receiving means 58.

More specifically, the board 12 is produced by draping of a composite material.

According to a preferred embodiment, the board 12 comprises a skin 60 made of composite material. This skin 60 that is made of composite material forms a draping around the core 62 of the board 12, whereby said draping covers all or part of the receiving means 58 located in the lower part 34 of the board. The receiving means 38 of each wheel support 14 are therefore integrated in the board 12 using the draping of the skin 60 made of composite material around the core 62.

Said core 62 consists of a material, in particular a synthetic foam, less resistant and lighter than the material that constitutes the skin 60. However, this core 62 has an adequate density for absorbing the stresses undergone by the board 12 during certain violent impacts and for providing minimum inertia to the board during the execution of certain figures in which the skateboard 10 is put into rotation by the user.

Said core 62 can consist of a single block of a material of homogeneous density, but preferably, said core 62 comprises reinforcement inserts 64 of a material with a higher density at the most stressed zones of the board or within which high contact and/or friction stresses occur. Said most stressed zones are found at receiving means 58 and ends 56 of the board 12, corresponding respectively to the contours C1 and C2 that are illustrated in FIG. 3, as well as at side parts L.

Thus, as illustrated in FIG. 4 and according to its preferred embodiment, the board 12 according to the invention comprises a skin 60 that completely envelops a foam core 62, whereby said core 62 comprises foam reinforcement inserts 64 with a density that is approximately greater at ends 56 of the board 12 as well as at receiving means 58.

The higher-density foam reinforcement inserts 64, located at receiving means 58 or at ends 56 of the board 12, have a contour that essentially corresponds to the contours C1 and C2, and said reinforcement inserts 64 can occupy essentially the entire thickness of the core 62 at right angles with the surface that is defined by each of the contours C1 and C2, whereby the thickness of the core 62 corresponds to the height that is inside the skin 60 between the upper part 30 and the lower part 34 of the board 12.

At its ends 56, or at the level of the zone delimited by the contour C2, the board 12 is severely stressed by the user during the execution of jumps with the skateboard 10, also called "ollies," or else when said skateboard 10 strikes an obstacle. The two ends 56 of a board 12 can be reinforced with higher-density reinforcement insert means 64.

However, the forces exerted by the weight and the movements of the user on the upper part 30 of the board 12 pass through the receiving means 58 before being taken up by the ground, and particularly the highest internal stresses appear at the surface that is essentially delimited by the contour C1.

According to its preferred embodiment, the core 62 comprises a reinforcement insert 64 of a higher-density material at right angles with the receiving means 58 of the board 12.

According to an embodiment, the receiving means 58 of the board 12 consist of a part in relief 66 that rises from the outside surface S of the lower part 34 of the board 12.

Said part in relief 66, with a base that is essentially identical to the contour C1, is equipped with a recess 68 that makes it possible to accommodate the pin 52 of the means 28 for orientation of a wheel support 14 and the engagement means 38 that allow it to accommodate the means 26 for attachment of a wheel support 14.

According to a first embodiment, illustrated in FIG. 4, the engagement means 38 consist of a threaded rod 70 for a part that is embedded in the part in relief 66 of the board 12 during its manufacturing. The core 62 or a reinforcement insert 64 and the skin 60 of the part in relief 66 of the board 12 immobilize said threaded rod 70 in rotation, in particular by the means of a flat surface or any other means of locking against rotating known by one skilled in the art. The shaft of the threaded rod 70 essentially coincides with the reference shaft B.

According to a second embodiment, illustrated in FIG. 5, the engagement means 38 consist of a threaded insert 72 that can accommodate the threading of the shaft 36, or the threading of a screw that can replace the shaft 36 and the tightening nut 50. The shaft of the threaded insert 72 essentially coincides with the reference shaft B. The core 62 or a reinforcement insert 64 and the skin 60 of the part in relief 66 of the board 12 immobilizing said threaded insert 72 so as to lock it against rotating, in particular by means of a flat surface or any other means of locking against rotating known to one skilled in the art. The threaded insert 72 can be arranged so as to be essentially flush with the skin at the upper face 74 of said part in relief 66.

According to a third embodiment of the engagement means 38, presented in detail in FIG. 8, said engagement means 38 consist of a shaft 71, in particular a screw with a hexagonal head, and an insert that are assembled in a housing 75. Said insert 73 is embedded in the part in relief 66 of the board 12 during its manufacturing, and the housing 75 empties into the upper part 30 of said board as well as at the upper face 74 of said part in relief 66. The insert 73 is locked in the housing 75 against translation by a shoulder or by any other mechanical means. So as to allow the tightening of the attachment means 26 of the wheel supports 14, the shaft 71 is locked against rotating. The locking against rotating of the shaft 71 is carried out by a flat surface, or any other means that allows a stopping in rotation in the housing 75, or the insert 73 is located in rotation in the housing 75, and the assembly of the shaft 71 with the insert 73 is integral in rotation. The shaft 71 essentially coincides with the reference shaft B. This third embodiment of the engagement means 38 allows an easy change of the shaft 71, whereby the breaking of the latter can be carried out inside the part in relief 66. So as to limit the penetration of water in particular and to preserve an upper part 30 of uniform surface, a plug for sealing the housing 75 at said upper part 30 of the board may be provided.

According to a first embodiment, illustrated in FIG. 6, the recess 68, able to accommodate the tip 54 of the pin 52 of the means 28 for orientation of a wheel support 14, comprises an essentially cylindrical inside wall 76 and an essentially semi-cylindrical and even essentially conical bottom 78. The shaft of the recess 68 essentially coincides with the reference shaft C. This recess 68 is equipped with a flexible insert 80, in particular made of rubber or a flexible plastic and/or with a collar, for accommodating the tip 54 of the pin 52 of the orientation means 28. Said flexible insert 80, covering the inside wall 76 and the bottom 78 of said recess 68, is able to deform and to compress so as to produce the ball-joint connection necessary to the orientation means 28 to put in rotation the wheel support 14.

According to a second embodiment, illustrated in FIG. 7, the recess 68, able to accommodate the tip 54 of the pin 52 of the orientation means 28 of a wheel support 14, comprises an essentially cylindrical inside wall 76 and an essentially flat bottom 78. The shaft of the recess 68 essentially coincides with the reference shaft C. This recess 68 is generally equipped with a semi-rigid insert 82, in particular made of rigid plastic and without a collar to allow the semi-rigid insert 82 to slide into the recess 68, for the accommodation of the tip 54 of the pin 52 of the orientation means 28. Said semi-rigid insert 82 has a depth that is significantly less than the depth of the recess 68 so as to provide an essentially cylindrical space E, and with shaft C, located between the bottom 84 of said semi-rigid insert 82 and the bottom 78 of said recess 68. This space E is used for the insertion of an absorption element 86 that is essentially cylindrical in shape and that is made of a material, in particular elastomer, that can absorb vibrations. Said absorption element 86 is located on the bottom 78 of the recess 68 such that its shaft is essentially perpendicular to the shaft of said recess 68, and therefore to the shaft of the semi-rigid insert 82.

Said absorption element 86 can assume all the desired shapes and can be made in any material that can absorb vibrations during the use of the skateboard 10. This absorption element 86 is easily replaceable.

According to a design that is analogous to those of the prior art and that allows the orientation of a wheel support 14 according to the invention, the transversal plane of the recess 68, essentially perpendicular to the shaft C, and the transversal plane of the shaft 36 or the threaded insert 72 of the engagement means 38, essentially perpendicular to the shaft B, are both slightly inclined relative to the horizontal line, one facing the other.

According to an embodiment, the board 12 according to the invention comprises, at the lower part 34, at least one sliding face 88 that facilitates the production by the user of figures, called "slides," executed by making the skateboard 10 slide over an obstacle.

A sliding face 88 is made by a part in relief, in particular manufactured with the board 12 such as the receiving means 58, located at the lower part 34 of said board 12, formed by an elevation of the skin 60 and the core 62 or a reinforcement insert 64, above the surface S of the lower part 34 of said board 12.

A sliding face 88 is ideally located close to receiving means 58, more particularly along a shaft G, rectilinear or curvilinear, essentially transverse to the shaft M of the board 12 and illustrated in FIG. 3.

This sliding face 88 may have a profile that is essentially perpendicular to the plane that corresponds to the surface S of the lower part 34, or an inclined profile so as to be essentially parallel to the closest shaft B or C, as illustrated in FIGS. 4 and 7, to provide a good support surface during figures called "slides."

Advantageously, so as to better exit from the "grind" during certain figures, this sliding face 88 can have edges of different slopes.

According to an embodiment illustrated in FIG. 3, the part in relief 66 that forms the receiving means 58 comprises at least one front blank AV, at least one rear blank AR, and at least two side blanks AL. The front blank AV and the rear blank AR are the two blanks of said part in relief 66 that are essentially transverse to the shaft M and located on both sides of the side blanks AL of said part in relief 66.

According to a preferred embodiment, at least one sliding face 88 corresponds to at least one front blank AV, rear blank AR, or side blank AL of the part in relief 66. At a sliding face 88 or its ends 56, the skin 60 of the board 12 can advantageously receive a treatment, a superimposed coating, such as a metallic reinforcement, or protection added to protect the fibers of the skin 60 from friction.

According to the preferred embodiment of the board 12 of the skateboard 10, the side blanks AL of the part in relief 66 that form the receiving means 58 have a profile that is optimized for distributing the forces in the core 62 and/or the reinforcement inserts 64 of the board 12 as well as possible. Various profiles taken by the side blanks AL of the part in relief 66 and optimized by methods for calculating mechanical forces, in particular by the finite-elements method, are illustrated in FIGS. 5 and 6.

The invention claimed is:

1. A skateboard (10) comprising:

a board (12) with an upper part (30) and a lower part (34);

wheel supports (14);

means (28) for orientation of said wheel supports (14), whereby said means (28) for orientation comprises a pin (52) whose tip (54) is housed in a recess (68) so as to create a connection that is essentially equivalent to a ball joint;

wherein the lower part (34) comprises receiving means (58) that are manufactured with said board (12) and are able to accommodate each wheel support (14), wherein the board (12) is formed of at least one composite material, wherein the receiving means (58) of the board (12) comprises at least one part in relief (66) that is located in the lower part (34), whereby said part in relief (66) comprises engagement means (38) and said recess (68), and wherein the engagement means (38) comprises a shaft (71) and an insert (73) that are assembled in a housing (75) that empties into the upper part (30) of the board (12) as well as at the upper face (74) of said part in relief (66), whereby the insert (73) is locked in the housing (75) against translation and the shaft (71) is locked against rotating.

2. The skateboard (10) according to claim 1, wherein the board (12) comprises at least one sliding face (88) that is located in the lower part (34) of said board.

3. The skateboard (10) according to claim 2, wherein the at least one sliding face (88) has edges of different slopes.

4. The skateboard (10) according to claim 3, wherein at least one sliding face (88) corresponds to at least one front blank (AV), rear blank (AR), or side blank (AL) of the part in relief (66).

5. The skateboard (10) according to claim 1, wherein the board (12) comprises a skin (60) that forms a draping around a core (62), in particular made of foam, whereby said draping covers all or part of the receiving means (58) that are located in the lower part (34).

6. The skateboard (10) according to claim 5, wherein in addition to the receiving means (58), the board (12) comprises two ends (56) and side parts (L), and wherein the core (62) of the board (12) comprises at least one reinforcement insert (64) at right angles with receiving means (58), ends (56) of said board (12) and/or side parts (L).

7. The skateboard (10) according to claim 1, wherein the board (12) is made by draping at least one composite material.

8. The skateboard (10) according to claim 1, wherein the board (12) is made by draping at least one composite material.

9. The skateboard (10) according to claim 1, wherein the recess (68) comprises an inside wall (76), essentially cylindrical, and a bottom (78), essentially semi-cylindrical or essentially conical, covered by a flexible insert (80).

10. The skateboard (10) according to claim 1, wherein the recess (68) comprises an inside wall (76), essentially cylindrical, and a bottom (78), essentially flat, covered by a semi-rigid insert (82), whereby said semi-rigid insert (82) has a depth that is considerably less than the depth of the recess (68) so as to preserve a space E for the insertion of an absorption element (86).

* * * * *